United States Patent [19]

Endo et al.

[11] 3,990,907

[45] Nov. 9, 1976

[54] METHOD OF REMOVING VACUUM EVAPORATED SELENIUM PHOTORESPONSIVE LAYER FROM BASE MATERIAL OF DRUM OF ELECTROPHOTOGRAPHIC APPARATUS

[75] Inventors: Katutoshi Endo; Makoto Ohira, both of Tokyo; Shinichi Nomura, Hatano, all of Japan

[73] Assignees: Ricoh Co., Ltd.; Stanley Electric Co., Ltd., both of Tokyo, Japan

[22] Filed: Sept. 26, 1974

[21] Appl. No.: 509,378

[30] Foreign Application Priority Data

Dec. 6, 1973 Japan ..... 48-135733

[52] U.S. Cl. ..... 134/2; 29/426; 113/1 K; 134/17

[51] Int. Cl.[2] ..... C23G 1/00; B08B 7/02

[58] Field of Search ..... 134/6, 38, 2, 17; 241/23; 423/510; 29/426; 113/1 K

[56] References Cited

UNITED STATES PATENTS

| | | | |
|---|---|---|---|
| 1,980,156 | 11/1934 | Emrick | 29/426 X |
| 2,254,980 | 9/1941 | Simmons | 134/22 C X |
| 2,816,008 | 12/1957 | von Stein | 423/510 |
| 3,338,756 | 8/1967 | Leon | 134/38 X |
| 3,455,737 | 7/1969 | Seibert | 134/17 |
| 3,592,691 | 7/1971 | Stelter | 134/38 X |
| 3,724,059 | 4/1973 | Celousky | 29/426 |
| 3,801,369 | 4/1974 | Gregory et al. | 134/38 X |
| 3,837,815 | 9/1974 | Bixby | 134/17 X |

FOREIGN PATENTS OR APPLICATIONS

| | | | |
|---|---|---|---|
| 4,499 | 4/1885 | United Kingdom | 29/426 |

*Primary Examiner*—Joseph Scovronek
*Assistant Examiner*—Arnold Turk
*Attorney, Agent, or Firm*—Frank J. Jordan

[57] ABSTRACT

To remove an old photoresponsive or photoconductive selenium layer from a drum of a copy machine as preparation for the vacuum evaporation of a new photoresponsive layer thereonto, the drum is immersed in a hot fluid such as water, steam or liquid or vapor trichloroethylene or perchloroethylene. Due to the softening of the photoresponsive layer and the difference between the coefficients of thermal expansion of the photoresponsive layer and the drum material, the photoresponsive layer may be subsequently easily physically removed from the drum.

3 Claims, No Drawings

METHOD OF REMOVING VACUUM EVAPORATED SELENIUM PHOTORESPONSIVE LAYER FROM BASE MATERIAL OF DRUM OF ELECTROPHOTOGRAPHIC APPARATUS

The present invention relates generally to electrophotography, and specifically to the removal of a vacuum evaporated photoresponsive layer containing selenium as the main photoresponsive or photoconductive element from the base material of a copy drum as preparation for the vacuum evaporation of a new photoresponsive layer thereon.

In an electrophotographic apparatus to which the present invention is applicable, a metal copy drum is coated with a photoresponsive or photoconductive layer containing selenium as the main photoconductive element. In operation, the drum is sequentially utilized in the steps of charging, imaging, developing and transferring to produce a replica of the surface of an original document on a sheet of copy paper. During the imaging step, an image of the surface of the original document is optically projected onto the surface of the photoresponsive layer, and an increase in the conductivity of the photoresponsive layer in those areas on which light having a brightness greater than a selected value is incident corresponding to light areas of the original document results in the formation of a latent electrostatic image which is later developed and transferred to the copy sheet. Such electrophotographic apparatus is well known in the art, and further description will not be given herein.

A photoresponsive layer to which the present invention relates preferably contains selenium as the main or sole photoconductive element, and the photoresponsive layer is applied to the drum by evaporation or deposition in a vacuum. If desired, additives such as arsenic, sulfur, tellurium and the halogens may be incorporated into the photoresponsive layer to enhance various properties thereof, as is well known in the art. The drum is preferably made of a metal such as aluminum, brass or stainless steel. Although the present invention is described as relating to a selenium photoresponsive layer, it is not limited thereto, and the photoresponsive layer may be made of any material having properties similar to selenium.

When a copy drum as described above is used for a long period of time, the electrostatic properties of the photoresponsive layer deteriorate and the surface of the layer becomes abraded. Since the metal copy drum is expensive, it is more economical to replace the photoresponsive layer than the entire drum. In practice, the old photoresponsive layer is removed from the copy drum and a new photoresponsive layer is evaporated thereonto as described above. Prior art methods of removing the old photoresponsive layer from the drum include mechanical scraping and chipping. These methods, however, often cause damage to the surface of the metal drum requiring expensive refinishing or replacement. Another prior art method involves dissolving or softening the photoresponsive layer in an alkali solution, since selenium is highly soluble in alkali and insoluble in acid. The major drawback of this method is that the alkali corrodes the surface of the metal drum.

It is therefore an important object of the present invention to provide a method of removing a vacuum evaporated photoresponsive layer containing selenium as the main photoresponsive element from the base material of a metal copy drum which overcomes the above mentioned drawbacks of the prior art.

In summary, the method comprises the steps of immersing the drum in a hot fluid such as water, steam, or liquid or vapor trichroethylene or perchloroethylene and subsequently removing the photoresponsive layer physically using an instrument which will not damage the surface of the metal drum. This is possible since the action of the fluid will soften the photoconductive layer. A main principle of the present invention is that since the drum material and the material of the photoresponsive layer have different linear coefficients of thermal expansion, with that of the photoresponsive layer being greater, exposure to the hot fluid will urge the photoresponsive layer to separate from the metal drum so that it can be easily removed therefrom.

The above and other objects, features and advantages of the present invention will become clear from the following examples and description.

EXAMPLE 1

A photoresponsive layer containing selenium as the main photoresponsive element and having a coefficient of thermal expansion of $5.6 \times 10^{-5}/°$ C was vacuum evaporated onto an aluminum drum having a coefficient of thermal expansion of $2.32 \times 10^{-5}/°$ C. The drum was immersed in hot water of 90° C for 2 minutes, and then removed from the water into the atmosphere. As long as the photoresponsive layer remained hot, it was in a rubbery state and could be easily removed from the aluminum drum.

EXAMPLE 2

A photoresponsive layer was evaporated onto an aluminum drum as described in EXAMPLE 1. The drum was immersed in hot water of 60° C for 20 minutes, and then removed from the water into the atmosphere. As long as the photoresponsive layer remained hot, it could be easily removed from the aluminum drum.

EXAMPLE 3

A photoresponsive layer was evaporated onto an aluminum drum as described in EXAMPLE 1. The drum was immersed in hot water at 55° C for one hour and then removed from the water into the atmosphere. The photoresponsive layer could not be easily removed from the aluminum drum.

EXAMPLE 4

A photoresponsive layer was evaporated onto an aluminum drum as described in EXAMPLE 1. The drum was then immersed into an environment of hot trichloroethylene vapor at 87° C for 5 minutes. The photoresponsive layer could be easily removed from the aluminum drum both in the trichloroethylene environment and after being removed therefrom into the atmosphere as long as the photoresponsive layer remained hot.

EXAMPLE 5

A photoresponsive layer containing selenium as the main photoresponsive element and having a coefficient of thermal expansion of $5.6 \times 10^{-5}/°$ C was vacuum evaporated onto a brass drum having a coefficient of thermal expansion of $1.8 \times 10^{-5}/°$ C. The drum was immersed in a trichloroethylene solution of 89° C for 3 minutes, and then removed from the solution into the atmosphere. The photoresponsive layer was easily separated from the aluminum drum in the atmosphere.

EXAMPLE 6

A photoresponsive layer was evaporated onto an aluminum drum as described in EXAMPLE 1. The drum was then immersed into an environment of hot perchloroethylene vapor 121.2° C for 5 minutes. The photoresponsive layer could be easily removed from the aluminum drum both in the perchloroethylene environment and after being removed therefrom into the atmosphere as long as the photoresponsive layer remained hot.

EXAMPLE 7

A photoresponsive layer was evaporated onto a brass drum as described in EXAMPLE 5. The drum was then immersed in a perchloroethylene solution of 89° C for 3 minutes, and then removed from the solution into the atmosphere. The photoresponsive layer was easily removed from the brass drum in the atmosphere.

EXAMPLE 8

A photoresponsive layer containing selenium as the main photoresponsive element and 6% by weight of tellurium as an additive having a coefficient of thermal expansion of $5.3 \times 10^{-5}/°$ C was evaporated onto a stainless steel drum having a coefficient of thermal expansion of $1 \times 10^{-5}/°$ C.

The drum was then immersed into an environment of steam of 150° C for 5 minutes. The photoresponsive layer could be easily removed from the stainless steel drum both in the steam environment and after being removed therefrom into the atmosphere as long as the photoresponsive layer remained hot.

EXAMPLE 9

A photoresponsive layer containing selenium as the main photoresponsive element and 5% by weight of arsenic as an additive having a coefficient of thermal expansion of $2.84 \times 10^{-5}/°$ C was evaporated onto an aluminum drum having a coefficient of thermal expansion of $2.32 \times 10^{-5}/°$ C. The drum was then immersed into an environment of hot perchloroethylene vapor for 5 minutes. The photoresponsive layer could be easily removed from the aluminum drum both in the perchloroethylene environment and after being removed therefrom as long as the photoresponsive layer remained hot.

EXAMPLE 10

A photoresponsive layer was evaporated onto an aluminum drum as described in EXAMPLE 1. The drum was then immersed into an environment of steam at 180° C for 5 minutes. The photoresponsive layer could be easily removed from the aluminum drum both in the steam environment and after being removed therefrom into the atmosphere as long as the photoresponsive layer remained hot. However, the aluminum drum was distorted by the heat, and a new photoresponsive layer evaporated onto the drum produced images of uneven density.

Within the scope of the present invention, the photoresponsive layer may be removed from the metal drum either while the drum remains in the hot fluid or after it has been removed from the fluid into the atmosphere as long as the photoresponsive layer remains hot. The temperature of the hot fluid is preferably between 60° C and 150° C since lower temperatures will not sufficiently urge the photoresponsive layer to separate from the metal drum and higher temperatures will distort the metal drum. The basic principle of the present invention is that a difference must exist between the coefficients of thermal expansion of the photoresponsive layer and the metal drum, preferably on the order of or greater than $3 \times 10^{-5}/°$ C. It has been determined experimentally that the method of the present invention is highly effective if the surface of the metal drum has been buffed, diamond abrasive polished or otherwise finished to a high degree of smoothness. The present invention is not effective, however, with metal drums having rough surfaces. Sandblasting, liquid honing and other methods producing surface roughness of 100 to 1000 mesh do not produce a sufficiently smooth surface finish on a metal copy drum.

It will be appreciated that the method of the present invention allows recycling of the material of the photoresponsive layer after removal from the copy drum as well as reuse of the copy drum itself.

What is claimed is:

1. A method of removing a photoresponsive layer containing selenium as the main photoresponsive element from a base material having a high degree of smoothness, said photoresponsive layer and said base material having different linear coefficients of thermal expansion, comprising the steps of:

a. exposing the photoresponsive layer and the base material to a hot fluid for a period whereby the photoresponsive layer is softened to a rubber-like state, the hot fluid being selected from the group consisting of water, trichloroethylene and perchloroethylene, the temperature of the hot fluid being between 55° C and 150° C; and b. physically removing the photoresponsive layer from the base material while the photoresponsive layer remains hot.

2. The method according to claim 1, in which the temperature of the hot fluid is between 60° C and 100° C.

3. The method according to claim 1, in which the difference between the coefficients of thermal expansion of the photoresponsive layer and the base material is greater than $3 \times 10^{-5}/°$ C.

* * * * *